US011548033B2

(12) United States Patent
Arlott et al.

(10) Patent No.: US 11,548,033 B2
(45) Date of Patent: Jan. 10, 2023

(54) SIEVING DEVICE

(71) Applicant: GERICKE LTD., Ashton under Lyne (GB)

(72) Inventors: Colin Arlott, Ashton under Lyne (GB); Markus H. Gericke, Zollikon (CH)

(73) Assignee: GERICKE LTD., Lancashire (GB)

( * ) Notice: Subject to any disclaimer, the term of this patent is extended or adjusted under 35 U.S.C. 154(b) by 0 days.

(21) Appl. No.: 17/324,682

(22) Filed: May 19, 2021

(65) Prior Publication Data

US 2021/0362191 A1 Nov. 25, 2021

(30) Foreign Application Priority Data

May 20, 2020 (EP) ..... 20175817

(51) Int. Cl.
*B07B 1/46* (2006.01)
*B07B 1/22* (2006.01)

(52) U.S. Cl.
CPC ..... *B07B 1/469* (2013.01); *B07B 1/22* (2013.01)

(58) Field of Classification Search
CPC .... B07B 1/18; B07B 1/22; B07B 1/46; B07B 1/469; B07B 1/4636
See application file for complete search history.

(56) References Cited

U.S. PATENT DOCUMENTS 1,587,291 A * 6/1926 Farasey ..... B07B 1/18 193/31 R
2017/0151585 A1* 6/2017 Charreyre ..... B07B 1/24

FOREIGN PATENT DOCUMENTS

EP 0910252 B1 * 2/1997 ..... A23C 19/00
EP 0910252 B1 * 2/1997 ..... A47J 43/255
EP 0910252 B1 * 9/2000
FR 430562 A 10/2011
WO WO-8404473 A1 * 9/1984 ..... B07B 1/26
WO WO8404473 A1 * 11/1984

* cited by examiner

*Primary Examiner* — Terrell H Matthews
(74) *Attorney, Agent, or Firm* — Perry + Currier Inc.

(57) ABSTRACT

The invention is based on a sieving device with at least one rotary drum unit comprising a plurality of sieving openings, said sieving openings being respectively arranged around a centre point of the sieving openings and being categorized in at least one structure group and at least one further structure group and at least one further structure group, wherein the first structure group the centre points of neighbouring sieving openings are arranged at a first intra-distance to one another, and wherein in the further structure group the centre points of neighbouring sieving openings are arranged at a further intra-distance to one another, wherein the smallest structure distance between a centre point of at least one sieving opening in the at least one first structure group and a nearest situated center point of at least one sieving opening in the at least one further structure group is greater than the first intra-distance.

8 Claims, 3 Drawing Sheets

SIEVING DEVICE

STATE OF THE ART

Figure 1:
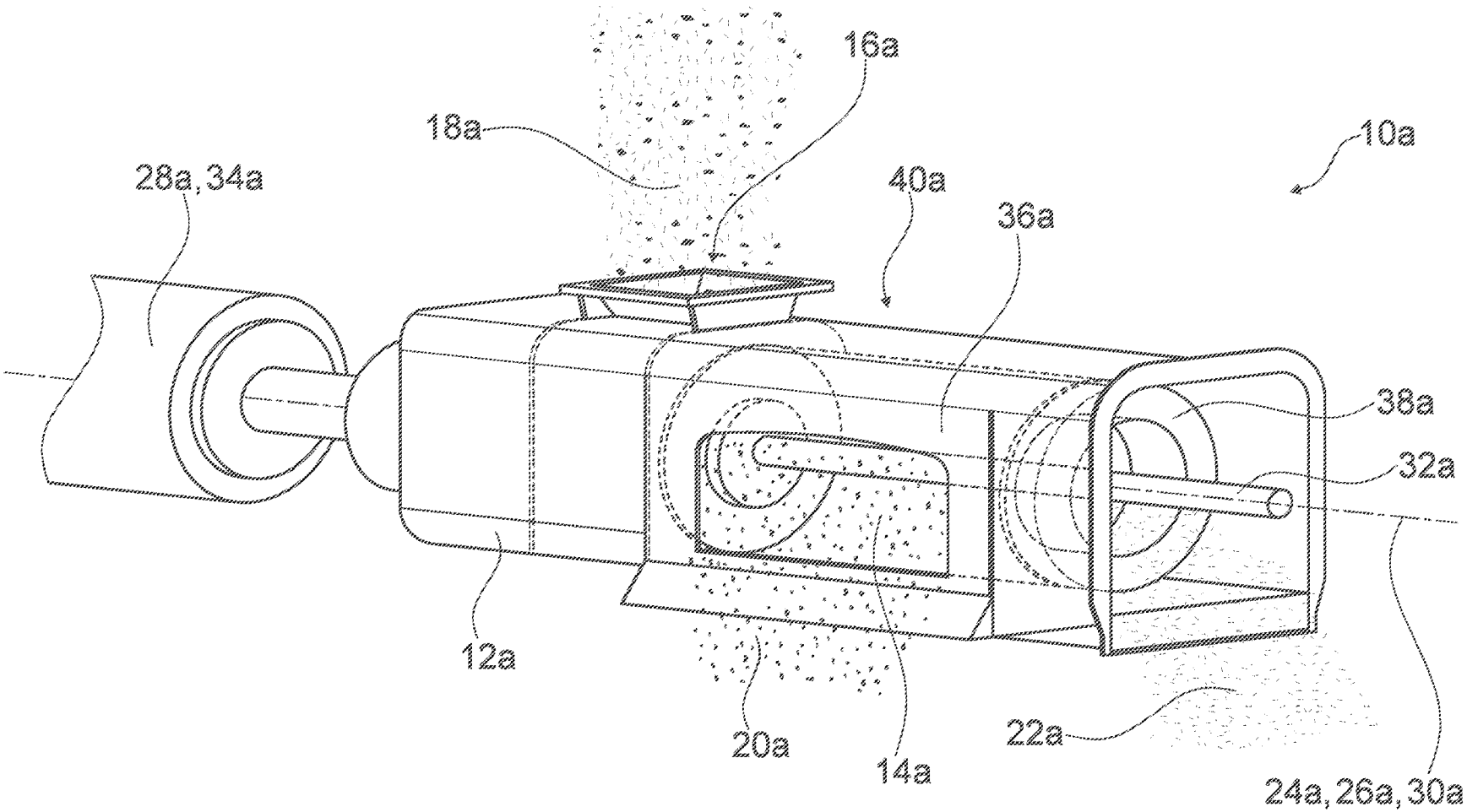

The invention relates to a sieving device with at least one rotary drum unit comprising a plurality of sieving openings, said sieving openings being respectively arranged around a centre point of the sieving openings and being categorized in at least one first structure group and at least one further structure group, wherein in the first structure group the centre points of neighbouring sieving openings are arranged at a first intra-distance to one another, and wherein in the further structure group the centre points of neighbouring sieving openings are arranged at a further intra-distance to one another, according to the preamble of claim 1.

The objective of the invention is in particular to provide a generic device having improved characteristics regarding wear-resistance. The objective is achieved according to the invention by the features of patent claim 1 while advantageous implementations and further developments of the invention may be gathered from the dependent claims.

Advantages of the Invention

The invention is based on a sieving device with at least one rotary drum unit comprising a plurality of sieving openings, said sieving openings being respectively arranged around a centre point of the sieving openings and being categorized in at least one first structure group and at least one further structure group, wherein in the first structure group the centre points of neighbouring sieving openings are arranged at a first intra-distance to one another, and wherein in the further structure group the centre points of neighbouring sieving openings are arranged at a further intra-distance to one another.

It is proposed that a smallest structure distance between a centre point of at least one sieving opening in the at least one first structure group and a nearest-situated centre point of at least one sieving opening in the at least one further structure group is greater than the first intra-distance.

Preferably the sieving device is embodied as a rotation sieving device, in particular for a sieving of materials to be sieved, in particular powder-like materials to be sieved, like for example food materials and/or chemical substances, preferentially for the purpose of separating foreign materials out of powders and/or of sorting a powder by particle sizes. The sieving device preferably comprises a housing unit. Preferentially the rotary drum unit is, in particular at least substantially completely, arranged in the housing unit. Preferably the sieving device comprises a filling-in channel for a filling-in of the material to be sieved into the housing unit, preferentially into the rotary drum unit. Preferably the sieving device comprises a motor unit that is configured for driving the rotary drum unit for rotation. Preferentially the rotary drum unit is implemented as a hollow-cylinder unit defining a cylinder axis. The motor unit is preferably configured to drive the rotary drum unit for a rotation around the cylinder axis. The cylinder axis of the rotary drum unit is preferably aligned parallel to a longitudinal axis of the rotary drum unit. By a "longitudinal axis" of an object is preferably a geometrical axis to be understood that extends parallel to a longest outer edge of a smallest imaginary rectangular cuboid just still completely enclosing the object. Preferably the longitudinal axis of the rotary drum unit is aligned at least substantially parallel to a longitudinal axis of the housing unit. Preferentially the sieving device comprises a suspension axle, in particular a materially implemented suspension axle, which in particular the rotary drum unit is connected to. The suspension axle is preferably connected with the motor unit, in particular via a gear unit. The sieving device preferably comprises the gear unit. Preferentially the motor unit is configured to drive the suspension axle for a rotation, in particular to drive the rotary drum unit via the suspension axle. "Configured" is in particular to mean specifically programmed, designed and/or equipped. By an object being configured for a certain function is in particular to be understood that the object fulfils and/or executes said certain function in at least one application state and/or operation state. The material to be sieved is preferably configured, in the operation state, for being moved through the rotary drum unit along the longitudinal axis of the rotary drum unit, in particular with the rotary drum unit rotating.

The rotary drum unit is preferably implemented of at least one, in particular perforated, metal sheet, which is in particular bent to form a cylinder. In particular the rotary drum unit may comprise cylinder frame elements, which the at least one metal sheet is connected to. In particular the rotary drum unit may comprise a rotary impeller unit for a mixing of the material to be sieved in a rotation, in particular for making use of a centrifugal force. The rotary drum unit may be implemented of a plurality of metal sheets.

Preferentially the at least one metal sheet forms a sieving sheet of the rotary drum unit. Preferably the at least one metal sheet comprises a plurality of sieving openings, which are in particular of the same size, particularly preferably having the same shape. Preferentially the sieving openings are respectively implemented symmetrically around a centre point. The sieving openings are preferably categorized into two different structure groups. Preferentially in the first structure group all the centre points of respectively neighbouring sieving openings are arranged at a defined distance, in particular the first intra-distance. Preferentially in the further structure group all the centre points of respectively neighbouring sieving openings are arranged at a defined distance, in particular the further intra-distance. A "neighbouring sieving opening in a structure group" is to mean the at least one nearest-situated sieving opening in the respective structure group. Preferably the at least one metal sheet is realized such that it is perforated in a pattern generated by the sieving openings in the first structure group and the further structure group, in particular at least to a large extent, preferably at least substantially, in particular completely except for edge regions of the at least one metal sheet.

Each structure group in particular extends, preferably at least substantially parallel to an outer edge of the metal sheet, over an entire extension of the metal sheet, in particular perpendicularly to a material thickness of the metal sheet, in particular at least over an entire region of the metal sheet that is configured to form the rotary drum unit. Each structure group comprises all neighbouring sieving openings whose centre points have the same distance from one another. In particular, each structure group comprises at least five sieving openings, preferably at least ten sieving openings, particularly preferably at least twenty sieving openings, which are in particular arranged at equal distances from one another.

It is possible to distinguish different structure groups from one another by the fact that within a structure group neighbouring sieving openings, in particular the centre points of neighbouring sieving openings, have a same distance from one another.

Different structure groups, in particular the centre points of neighbouring sieving openings of different structure groups, preferably have a distance from each other that differs from the respectively equal distances shown by centre points of neighbouring sieving openings within a structure group. Preferentially, on the metal sheet each structure group is repeated at least once. In particular, each sieving opening is allocatable to a structure group.

In particular, imaginary straight connection lines between the centre points of neighbouring sieving openings of different structure groups are free of coincident or intersection points with one another.

It is in particular possible for smallest geometrical, in particular imaginary, rectangles to be arranged on the metal sheet, in particular in a non-bent state, said rectangles comprising all the sieving openings of the respective different structure groups. In particular, the smallest geometrical rectangles which are arrangeable around the respective different structure groups do not show any overlap. Preferably outer edges of the smallest geometrical rectangles are aligned at least substantially parallel to the outer edge of the metal sheet, and in particular extend over an entire extension of the metal sheet, in particular at least over an entire region of the metal sheet that is configured to form the rotary drum unit.

In particular, for a differentiation of the structure groups, starting from not yet categorized sieving openings, all distances of neighbouring sieving openings, in particular of the centre points of neighbouring sieving openings, can be determined for an identification of the structure groups. Neighbouring sieving openings which are arranged at a smallest distance to one another may be allocated to the at least one, preferably a plurality of, first structure group(s). Neighbouring sieving openings which have not yet been allocated and are arranged at a smallest distance of all not yet allocated sieving openings may be allocated to (a) further structure group(s) accordingly.

The smallest structure distance is greater than the first intra-distance preferably by at least 0.1 mm, preferentially at least 0.5 mm, particularly preferably at least 1.0 mm and very particularly preferably at least 1.3 mm.

In particular, the metal sheet, in particular the perforated metal sheet, is realized in such a way that it has along a direction of the shortest distance between two sieving openings a greatest weakness regarding a break in an operation state. Suitable variation of the distances of the sieving openings will allow achieving a preferred wear-down direction of the metal sheet of the rotary drum unit due to a sieving operation.

By an implementation of the sieving device according to the invention it is in particular possible to achieve an advantageously low-wear rotary drum unit. In particular an advantageously controllable wear resistance of the rotary drum unit is achievable. In particular, a preferred wear-down direction is achievable along the shortest distance of two sieving openings of the rotary drum unit. In particular, an advantageously low-maintenance rotary drum unit is achievable.

It is further proposed that the smallest structure distance is smaller than the further intra-distance. Preferentially the smallest structure distance is smaller than the further intra-distance and greater than the first intra-distance. Preferably the smallest structure distance is smaller than the further intra-distance by at least 0.1 mm, preferably at least 0.5 mm, particularly preferably at least 1.0 mm and very particularly preferably at least 2.0 mm. An advantageous density of sieving openings of the at least one metal sheet is achievable, in particular on the at least one rotary drum unit.

Beyond this it is proposed that the sieving device comprises at least one further first structure group, wherein a centre point of at least one sieving opening in the at least one first structure group realizes a smallest structure repetition distance from a nearest-situated centre point of at least one sieving opening in the at least one further first structure group, said smallest structure repetition distance being greater than the first intra-distance and/or than the further intra-distance. The smallest structure repetition distance is greater than the first intra-distance and/or than the further intra-distance preferably by at least 0.1 mm, preferentially by at least 0.5 mm, particularly preferably by at least 1.0 mm and especially preferentially by at least 2.0 mm. The smallest structure repetition distance is greater than the greatest of the at least two intra-distances preferably by at least 0.1 mm, preferentially by at least 0.5 mm, particularly preferably by at least 1.0 mm and especially preferentially by at least 2.0 mm. An advantageous break-resistance of the metal sheet, in particular of the rotary drum unit, is achievable. In particular a preferred wear-down direction is achievable that is advantageously oriented along the smallest distances of the sieving openings.

Furthermore it is proposed that the smallest structure repetition distance is greater than the structure distance. The smallest structure repetition distance is greater than the structure distance preferably by at least 0.5 mm, preferentially by at least 0.5 mm, particularly preferably by at least 1.0 mm and very particularly preferably by at least 2.0 mm. An advantageous break resistance of the metal sheet, in particular of the rotary drum unit, is achievable. It is in particular possible to achieve a preferred wear-down region advantageously realized in a structure group, depending on which one of the two intra-distances is shortest.

It is also proposed that the at least one first structure group is implemented as a zigzag structure line. In particular, shortest distances between, in particular respectively nearest-situated, neighbouring sieving openings in the first structure groups run in a zigzag structure line. The sieving openings are in particular arranged in the corner points of the zigzag structure lines. Alternatively or additionally the at least one first structure group may be implemented as a straight structure line, as an undulate structure line and/or as an armchair structure line. Preferentially the at least one metal sheet is realized such that it is run through at least completely with sieving openings of the first structure groups. Preferably respectively neighbouring first structure groups are implemented as mutually inverted zigzag structure lines, which in particular implement the at least one metal sheet such that it is run through by sieving openings arranged in hexagons. The sieving openings of neighbouring first structure groups may be arranged in an alternative fashion, and may in particular together implement the at least one metal sheet such that it is run through with sieving openings arranged in rectangles, in particular squares, or in other shapes deemed expedient by someone skilled in the art. An advantageous preferred break direction along the zigzag structure line is achievable. It is in particular possible to prevent a detachment of a broken part of the metal sheet between routine inspections. It is in particular possible to achieve an advantageous reparability of the at least one metal sheet along the zigzag structure line.

Moreover it is proposed that the at least one further structure group is implemented as a straight structure line. In particular, shortest distances between neighbouring, in particular respectively nearest-situated, sieving openings in the further structure groups extend in a straight structure line. Alternatively or additionally the at least one further structure group may be realized at least partially as a zigzag structure line, an undulate structure line and/or an armchair structure line. Preferentially the at least one metal sheet is implemented to be at least substantially completely run through with sieving openings of the further structure groups. Preferably the at least one metal sheet is implemented with first and further structure groups alternating along at least one direction that is at least substantially perpendicular to the straight structure line. "At least substantially parallel" is here in particular to mean an orientation of a direction relative to a reference direction, in particular in a plane, wherein the direction has a deviation from the reference direction that is in particular smaller than 8°, advantageously smaller than 5° and especially advantageously smaller than 2°. The term "substantially perpendicular" is in particular to define an orientation of a direction relative to a reference direction, wherein the direction and the reference direction, in particular viewed in a plane, include an angle of 90° and the angle has a maximum deviation that is in particular smaller than 8°, advantageously smaller than 5° and especially advantageously smaller than 2°. Preferentially the sieving openings of the first structure groups form hexagons covering the metal sheet at least substantially completely. Preferably the centre points of the sieving openings of the further structure group are respectively arranged in a centre point of the hexagons formed on the at least one metal sheet by the first structure group. An advantageous density of sieving openings is achievable on the at least one metal sheet.

It is further proposed that the sieving openings in the at least one first structure group and the sieving openings in the at least one further structure group have a same shape. Preferably all the sieving openings have a same shape. It is possible to achieve a break resistance of the rotary drum unit, in particular of the at least one metal sheet, that is advantageously independent from a shape of a sieving opening. In particular an advantageously uniform sieving result is achievable.

Furthermore it is proposed that the sieving openings in the at least one first structure group and/or the sieving openings in the at least one further structure group have a rounded shape. The sieving openings in the at least one first structure group and/or the sieving openings in the at least one further structure group may have an oval shape. Preferentially the sieving openings in the at least one first structure group and/or the sieving openings in the at least one further structure group have a circular shape. Preferably all the sieving openings have a circular shape. An advantageous break resistance of the individual sieving openings is achievable, in particular by way of edge structures of the sieving openings which are implemented in an, at least macroscopically, even fashion.

It is also proposed that the sieving openings in the at least one structure group and/or the sieving openings in the at least one further structure group have an angular shape. The sieving openings in the at least one first structure group and/or the sieving openings in the at least one further structure group may in particular have a hexagonal, a rectangular, in particular square, a triangular and/or another shape that is deemed expedient by someone skilled in the art. An advantageous combination is achievable of increased break resistance in one direction and a preferred break direction with a reduced break resistance. It is in particular possible for sieving openings of a preferred break direction to be implemented in an advantageously cost-efficient manner.

Beyond this a method is proposed for a production of a sieving device according to the invention. In at least one method step the at least one rotary drum unit, in particular the at least one metal sheet, is provided with a plurality of sieving openings, which are respectively arranged around a centre point of the sieving openings and which are categorized into the at least one first structure group and the at least one further structure group, wherein in the first structure group the centre points of neighbouring sieving openings are arranged at the first intra-distance to one another, and wherein in the at least one further structure group the centre points of neighbouring sieving openings are arranged at the further intra-distance to one another, wherein a smallest structure distance between a centre point of at least one sieving opening in the at least one first structure group and a nearest-situated centre point of at least one sieving opening in the at least one further structure group is greater than the first intra-distance. An advantageously simple production method for the sieving device is achievable, which is in particular suitable for mass production.

The sieving device according to the invention and/or the method according to the invention are/is herein not to be limited to the application and implementation form described above. In particular, for fulfilling a functionality that is described here, the sieving device according to the invention and/or the method according to the invention may comprise a number of individual elements, structural components, units and/or method steps that differs from a number mentioned herein.

DRAWINGS

Further advantages may be gathered from the following description of the drawings. The drawings show two exemplary embodiments of the invention. The drawings, the description and the claims contain a plurality of features in combination. Someone skilled in the art will purposefully also consider the features individually and will find further expedient combinations.

Figure 2:
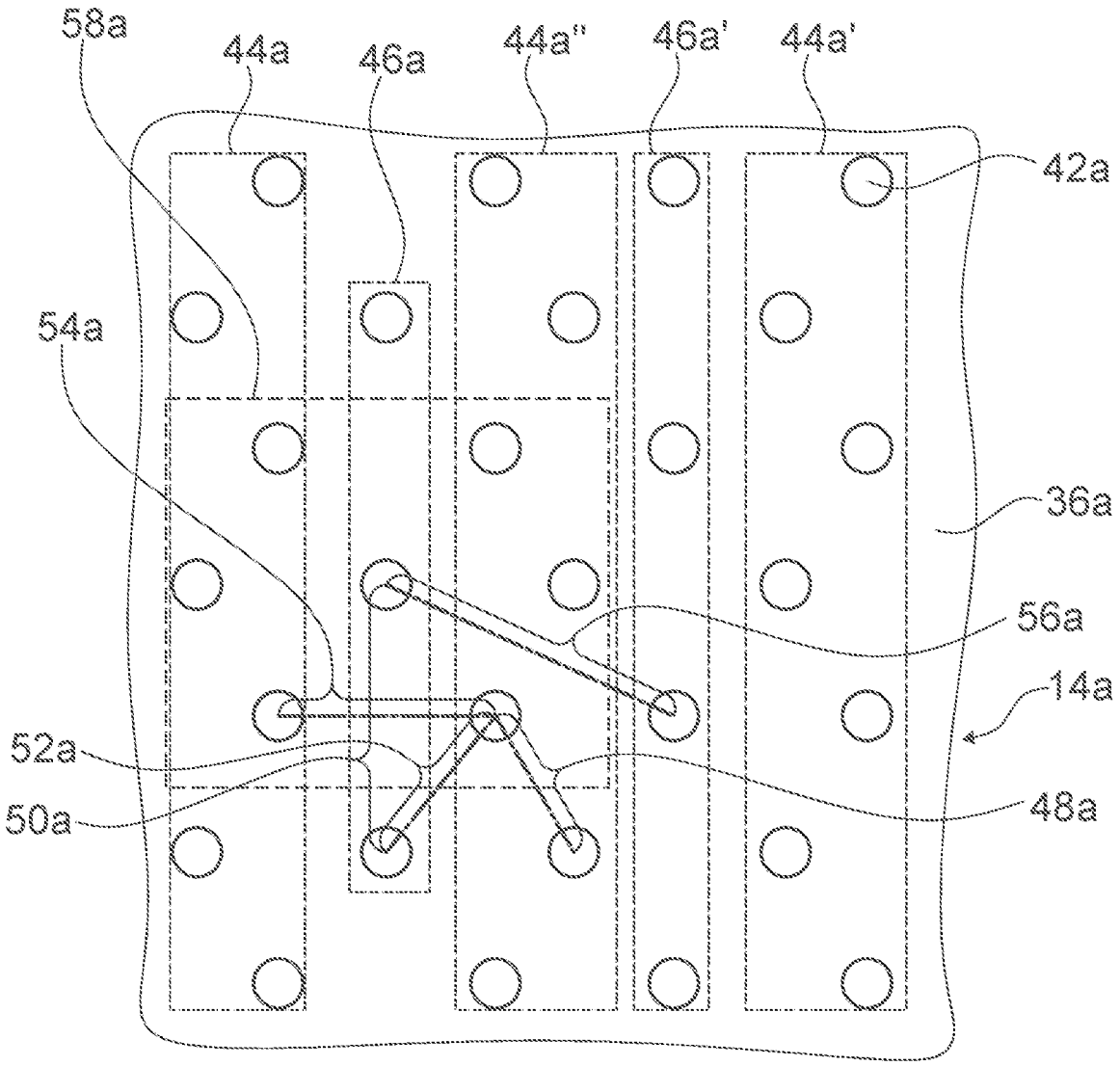
Figure 3:
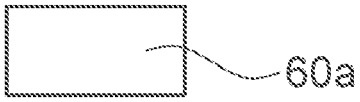
Figure 4:
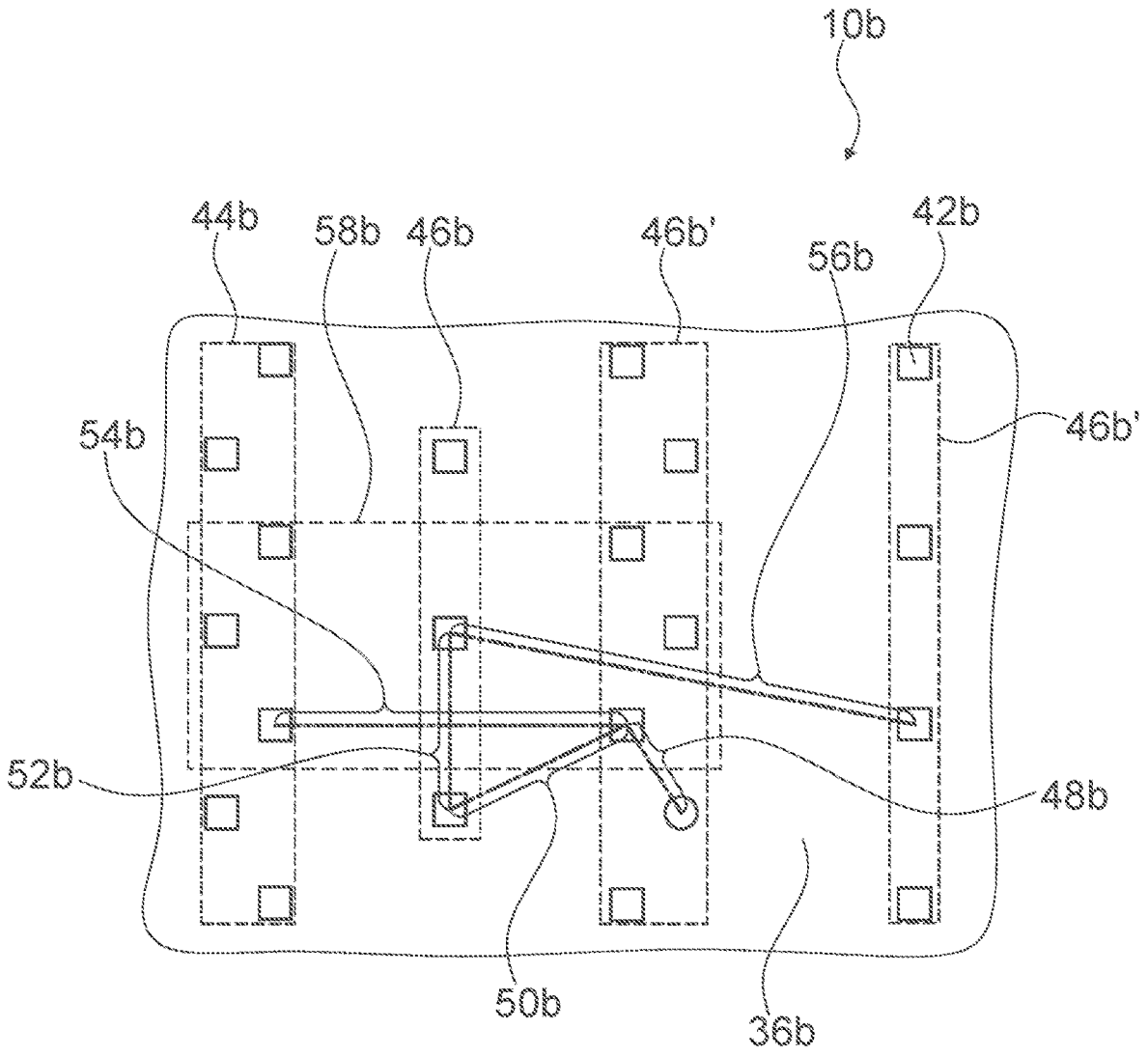

It is shown in:

FIG. 1 a sieving device according to the invention in a schematic representation, FIG. 2 a perforated metal sheet for a rotary drum unit of the sieving device according to the invention in a schematic representation, FIG. 3 a method according to the invention in a schematic representation and FIG. 4 a perforated metal sheet for a rotary drum unit of an alternative sieving device according to the invention in a schematic representation.

DESCRIPTION OF THE EXEMPLARY EMBODIMENTS

FIG. 1 shows a sieving device 10*a*. The sieving device 10*a* is embodied as a rotation sieving device. The sieving device 10*a* is configured for sieving materials to be sieved 18*a*, like for example food and/or chemical substances, by a rotary movement, in particular for separating off foreign materials out of powders and/or for sorting particle sizes of the powder.

The sieving device 10*a* comprises an at least substantially rectangular-cuboid-shaped housing unit 12*a*. The sieving device 10*a* comprises a rotary drum unit 14*a*, which is in particular configured for the sieving of the material to be sieved 18*a*. The rotary drum unit 14*a* is, in particular at least substantially completely, arranged in the housing unit 12*a*. The rotary drum unit 14*a* is embodied as a hollow-cylinder unit defining a cylinder axis 30*a*.

The sieving device 10*a* comprises a filling-in channel 16*a* for a filling-in of the material to be sieved 18*a* into the housing unit 12*a*, preferably into the rotary drum unit 14*a*. By way of the rotary movement the rotary drum unit 14*a* separates the material to be sieved 18*a* into a finer sieving portion 20*a*, which drops out of the rotary drum unit 14*a*, and a rougher sieving portion 22*a*, which in a sieving operation wanders through the rotary drum unit 14*a* along a longitudinal axis 24*a* of the rotary drum unit 14*a*.

The longitudinal axis 24*a* of the rotary drum unit 14*a* is in particular aligned parallel to a longitudinal axis 26*a* of the sieving device 10*a*, in particular of the housing unit 12*a*. The longitudinal axis 24*a* of the rotary drum unit 14*a* is in particular aligned parallel to the cylinder axis 30*a*.

The sieving device 10*a* comprises a motor unit 28*a*, which is configured to drive the rotary drum unit for a rotation.

The motor unit 28*a* is configured to drive the rotary drum unit 14*a* for a rotation around the cylinder axis 30*a*. The sieving device 10*a* comprises a materially implemented suspension axle 32*a*, which the rotary drum unit 14*a* is connected to. The suspension axle 32*a* is connected to the motor unit 28*a*, in particular via a gear unit 34*a*. The sieving device 10*a* may comprise the gear unit 34*a*. The motor unit 28*a* is configured to drive the suspension axle 32*a* for a rotation, in particular to drive the rotary drum unit 14*a* via the suspension axle 32*a*.

The rotary drum unit 14*a* is, for example, implemented of a perforated metal sheet 36*a*, which is in particular bent to form a cylinder, in particular forming a perforated sieving cylinder.

The rotary drum unit 14*a* comprises cylinder frame elements 38*a*, which the metal sheet 36*a* is connected to, by which the metal sheet 36*a* is in particular held in shape and via which the metal sheet 36*a* is connected with the suspension axle 32*a*.

The rotary drum unit 14*a* comprises, in particular on an inner side of the cylinder at the metal sheet 36*a*, a rotary impeller unit 40*a* for a mixing and conveying of the material to be sieved 18*a* in a rotation.

FIG. 2 shows the metal sheet 36*a* of the rotary drum unit 14*a*, in particular in a planar, non-bent state for the purpose of illustrating the arrangement of sieving openings 42*a*. By way of example and to provide a better overview, only one sieving opening 42*a* has been given a reference numeral.

The rotary drum unit 14*a*, in particular the metal sheet 36*a*, comprises a plurality of sieving openings 42*a*, which have an identical size and an identical shape. The sieving openings 42*a* are respectively, in particular symmetrically, arranged around a centre point of the sieving openings 42*a*.

The sieving openings 42*a* are categorized into first structure groups 44*a*, 44*a*', 44*a*" and further structure groups 46*a*, 46*a*'. FIG. 2 exemplarily shows that the sieving device 10*a* comprises a first structure group 44*a*. FIG. 2 exemplarily shows that the sieving device 10*a* comprises two further first structure groups 44*a*', 44*a*". The sieving device 10*a* comprises a further structure group 46*a*. The sieving device 10*a* comprises an additional further structure group 46*a*'.

The first structure groups 44*a*, 44*a*', 44*a*" are each embodied as a zigzag structure line. In particular, shortest distances between neighbouring, in particular respectively nearest-situated, sieving openings 42*a* in the first structure groups 44*a*, 44*a*', 44*a*" extend in a zigzag structure line.

The further structure groups 46*a* are each embodied as a straight structure line. In particular, shortest distances between neighbouring, in particular respectively nearest-situated, sieving openings 42*a* in the further structure groups 46*a*, 46*a*' extend in a straight structure line.

Respectively two neighbouring first structure groups 44*a*, 44*a*', 44*a*" are implemented as zigzag structure lines that are inverted to one another, in particular forming hexagon groups 58*a* of sieving openings 42*a*. In centre points of the hexagon groups 58*a*, sieving openings 42*a* of the further structure groups 46*a*, 46*a*' are arranged respectively.

The sieving openings 42*a* in the first structure groups 44*a*, 44*a*', 44*a*" and the sieving openings 42*a* in the further structure groups 46*a*, 46*a*' have a same shape, in particular a same outer contour. The sieving openings 42*a* in the first structure groups 44*a*, 44*a*', 44*a*" and the sieving openings 42*a* in the further structure groups 46*a*, 46*a*' have a rounded shape, in particular a circular shape.

The centre points of neighbouring sieving openings 42*a* in the first structure groups 44*a*, 44*a*', 44*a*" are arranged at a first intra-distance 48*a* to one another. The centre points of neighbouring sieving openings 42*a* in the further structure groups 46*a*, 46*a*' are arranged at a further intra-distance 50*a* to one another.

A smallest structure distance 52*a* is realized between a centre point of at least one sieving opening 42*a* in the first structure groups 44*a*, 44*a*', 44*a*" and a nearest-situated centre point of at least one sieving opening 42*a* in the further structure groups 46*a*, 46*a*'.

The smallest structure distance 52*a* between a centre point of at least one sieving opening 42*a* in the first structure groups 44*a*, 44*a*', 44*a*" and a nearest-situated centre point of at least one sieving opening 42*a* in the further structure groups 46*a*, 46*a*' is greater than the first intra-distance 48*a*.

The smallest structure distance 52*a*, in particular between a centre point of at least one sieving opening in the first structure groups 44*a*, 44*a*', 44*a*" and a nearest-situated centre point of at least one sieving opening 42*a* in the further structure groups 46*a*, 46*a*' is smaller than the further intra-distance 50*a*.

A smallest structure repetition distance 54*a* is greater than the, in particular smallest, structure distance 52*a*.

A centre point of at least one sieving opening 42*a* in the first structure group 44*a* realizes a smallest structure repetition distance 54*a* to a nearest-situated centre point of at least one sieving opening 42*a* in the at least one further first structure group 44*a*'. The smallest structure repetition distance 54*a* is greater than the first intra-distance 48*a*. The smallest structure repetition distance 54*a* is greater than the further intra-distance 50*a*.

A smallest further structure repetition distance 56*a* is greater than the, in particular smallest, structure distance 52*a*.

A centre point of at least one sieving opening 42*a* in the further structure group 46*a* realizes a smallest further structure repetition distance 56*a* to a nearest-situated centre point of at least one sieving opening 42*a* in the at least one additional further structure group 46*a*'. The smallest further structure repetition distance 56*a* is greater than the first intra-distance 48*a*. The smallest further structure repetition distance 56*a* is greater than the further intra-distance 50*a*.

FIG. 3 schematically shows a method for a production of the sieving device 10*a*.

In a method step, in particular a perforation step 60*a*, the at least one rotary drum unit 14*a*, in particular the at least one metal sheet 36*a*, is provided with a plurality of sieving openings 42*a*, which are respectively arranged around a centre point of the sieving openings 42*a* and which are categorized into the at least one further structure group 44*a*, 44*a*', 44*a*" and the at least one further structure group 46*a*, 46*a*', wherein in the first structure group 44*a*, 44*a*', 44*a*" the centre points of neighbouring sieving openings 42*a* are arranged at the first intra-distance 48*a* to one another and wherein in the further structure group 46*a*, 46*a*' the centre points of neighbouring sieving openings 42*a* are arranged at the further intra-distance 50*a* to one another, and wherein a smallest structure distance 52*a* between a centre point of at least one sieving opening 42*a* in the at least one first structure group 44*a*, 44*a*', 44*a*" and a nearest-situated centre point of at least one sieving opening 42*a* in the at least one further structure group 46*a*, 46*a*' is greater than the first intra-distance 48*a*.

In FIG. 4 a further exemplary embodiment of the invention is shown. The following description and the drawing are essentially limited to the differences between the exemplary embodiments, wherein regarding identically denominated components, in particular regarding components having the same reference numerals, principally the drawings and/or the description of the other exemplary embodiment of FIGS. 1 to 3 may be referred to. For the purpose of distinguishing between the exemplary embodiments the letter a has been added to the reference numerals of the exemplary embodiment in FIGS. 1 to 3. In the exemplary embodiment of FIG. 4 the letter a has been substituted by the letter b.

FIG. 4 in particular shows a metal sheet 36*b* of a rotary drum unit 14*b* of a sieving device 10*b*, in particular in a planar, non-bent state, for an illustration of the arrangement of sieving openings 42*b*. By way of example and to provide better overview, only one sieving opening 42*b* was given a reference numeral.

FIG. 4 exemplarily shows respectively two first structure groups 44*b*, 44*b*' and two further structure groups 46*b*, 46*b*'.

The sieving openings 42*b* in the at least one first structure group 44*b*, 44*b*' and the sieving openings 42*b* in the at least one further structure group 46*b*, 46*b*' have an angular shape, in particular a square shape.

A smallest structure distance 52*b* is greater than a further intra-distance 50*b*.

REFERENCE NUMERALS

10 sieving device
12 housing unit
14 rotary drum unit
16 filling-in channel
18 material to be sieved
20 sieving portion
22 sieving portion
24 longitudinal axis
26 longitudinal axis
28 motor unit
30 cylinder axis
32 suspension axle
34 gear unit
36 metal sheet
38 cylinder frame element
40 rotary impeller unit
42 sieving opening
44 structure group
46 structure group
48 intra-distance
50 intra-distance
52 structure distance
54 structure repetition distance
56 structure repetition distance
58 hexagon group
60 perforation step

The invention claimed is:

1. A sieving device with at least one rotary drum unit comprising a plurality of sieving openings, said sieving openings being respectively arranged around a centre point of the sieving openings and being categorized in at least one first structure group and at least one further structure group, wherein in the first structure group the centre points of neighbouring sieving openings are arranged at a first intra-distance to one another, and wherein in the further structure group the centre points of neighbouring sieving openings are arranged at a further intra-distance to one another, wherein a smallest structure distance between a centre point of at least one sieving opening in the at least one first structure group and a nearest-situated centre point of at least one sieving opening in the at least one further structure group is greater than the first intra-distance, wherein the sieving device comprises at least one further first structure group, wherein a centre point of at least one sieving opening in the at least one first structure group realizes a smallest structure repetition distance to a nearest-situated centre point of at least one sieving opening in the at least one further first structure group, said smallest structure repetition distance being greater than the first intra-distance and/or than the furthest intra-distance, and wherein the sieving openings in the at least one first structure group and the sieving openings in the at least one further structure group have a same shape.

2. The sieving device according to claim 1, wherein the smallest structure distance is smaller than the further intra-distance.

3. The sieving device according to claim 1, wherein the smallest structure repetition distance is greater than the structure distance.

4. The sieving device according to claim 1, wherein the at least one first structure group is implemented as a zigzag structure line.

5. The sieving device according to claim 1, wherein the at least one further structure group is implemented as a straight structure line.

6. The sieving device according to claim 1, wherein the sieving openings in the at least one first structure group and/or the sieving openings in the at least one further structure group have a rounded shape.

7. The sieving device according to claim 1, wherein the sieving openings in the at least one first structure group and/or the sieving openings in the at least one further structure group have an angular shape.

8. A method for a production of a sieving device according to claim 1.

* * * * *